US005217780A

United States Patent [19]

Wurzer

[11] Patent Number: 5,217,780

[45] Date of Patent: Jun. 8, 1993

[54] WOVEN TICKING, AND FABRIC STRUCTURE MADE THEREOF

[76] Inventor: Josef Wurzer, Rannersdorf 4, 8092 Mettersdorf, Austria

[21] Appl. No.: 971,051

[22] Filed: Nov. 3, 1992

[30] Foreign Application Priority Data

Nov. 5, 1991 [AT] Austria ..... 2198/91

[51] Int. Cl.[5] ..... B32B 1/04

[52] U.S. Cl. ..... 428/74; 5/482; 5/502; 139/420 R; 428/68; 428/225; 428/229

[58] Field of Search ..... 428/68, 74, 225, 229; 139/420 R; 5/482, 502

[56] References Cited

U.S. PATENT DOCUMENTS 4,535,016 8/1985 Bradley ..... 428/74

5,152,018 10/1992 Lea ..... 428/74

*Primary Examiner*—James J. Bell

*Attorney, Agent, or Firm*—Henry M. Feiereisen

[57] ABSTRACT

A woven ticking includes threads of natural fibers such as pure cotton with a mass surface density in the range of 100–150 g/m$^2$, preferably 110–140 g/m$^2$ at a thread thickness in the range of Nm 60–80, preferably Nm 65–75. Such a ticking is used in a covering and includes a filling of rabbit hair, in particular angora rabbit hair, and at least 30 weight-% foreign matter selected from the group consisting of silk, mohair, down, sheep wool, alpaca, camel hair, polyester fibers, yang hair and a mixture thereof.

21 Claims, 1 Drawing Sheet

WOVEN TICKING, AND FABRIC STRUCTURE MADE THEREOF

BACKGROUND OF THE INVENTION

The present invention refers to a ticking made through a textile weave of threads and, in particular, to a fabric structure of the type having a ticking and its filling.

Conventional tickings experienced problems with penetration of filling material through the ticking, in particular when the ticking includes fillings of angora rabbit hair (oryctolagus cuniculus angorensis). Such penetration of filling material should essentially be eliminated.

SUMMARY OF THE INVENTION

It is thus an object of the present invention to provide an improved ticking obviating the afore-stated drawbacks.

In particular, it is an object of the present invention to provide an improved ticking in which a penetration of filling material especially of angora rabbit hair is essentially eliminated.

It is yet another object of the present invention to provide a improved fabric structure such as a covering which is comprised of a ticking and its filling and is characterized by a high degree of heat insulation and a capability of rapid transport of moisture from one side to another.

These objects and others which will become apparent hereinafter are attained in accordance with the present invention by providing the ticking with threads, especially of natural fibers such as pure cotton, which have a mass surface density in the range of 100–150 g/m$^2$, preferably 110–140 g/m$^2$, and a thread size in the range of Nm 60–80, preferably Nm 65–75. The notation Nm refers to the size or fineness of a thread in the number-metric system (metric count) and indicates the length of the thread in meter divided by the weight in gram, i.e. for example Nm 60 describes a thread of 60 m length with a weight of 1 gram. In the tex system, the corresponding tex number is 1000/Nm.

The provision of such threads results in a tight ticking. Preferably, the textile weave is a plain weave with a pattern of e.g. L 1/1, or a twill weave. The use of such a textile weave ensures a tight interlacing of the threads of the fabric, and it is advantageous to provide the warp threads and the weft threads at a same size. A warp density of 42–50 thread/cm and/or a weft density of 35–45 thread/cm has been shown especially favorable.

A penetration of filling material through the ticking is essentially eliminated when providing a textile density according to WALZ of greater than 85%. The textile density according to WALZ is defined in the essays of Prof. Dr. Ing. Fr. Walz and chief inspector J. Luibrand "Die Gewebedichte I" and "Die Gewebedichte II" in publication "Textilpraxis", 1947, pages 330–366, Robert Kohlhammer-Verlag, Stuttgart, Germany.

Such a textile fabric can be made at high warp tension and, if necessary, with wet weft. During making of the fabric, it is thus possible to provide tighter warp threads compared to the weft threads.

The warp threads and/or weft threads have a yarn twist which may range between 850–950 T/m (turns per meter), to achieve a particularly high density of the ticking and thus to essentially prevent a penetration of filling through such a ticking.

The ticking can further be improved with regard to preventing filling material from penetrating through the ticking by treating the warp threads and/or weft threads through desizing, washing, stretching and repeated calendering.

Preferably, the fabric has an air permeability of 8–12 liter/dm$^2$·min.

The ticking in accordance with the present invention can be used for a fabric structure such as a covering, with the ticking including a filling of rabbit hair, preferably angora rabbit hair (oryctolagus cuniculus angorensis) and at least 30 weight-% of foreign matter e.g. silk such as tussah silk and/or mohair and/or down and/or sheep wool and/or alpaca and/or camel hair and/or polyester fibers and/or yang hair or the like.

A covering composed in this manner is characterized by a high degree of heat insulation and allows a rapid transport of moisture from one side to the other, especially when using angora rabbit hair as filling. Thus, a bed covering or quilt made in accordance with the present invention affords a very warm and cozy feeling. The admixture of foreign matters to the angora rabbit hair essentially eliminates a felting so that the covering not only is characterized by the advantageous properties of such fillings but is also usable over a long period.

According to yet another feature of the present invention, the filling is composed of two spaced layers o filling material with an interposed air cushion. Thus, it is possible to utilize two relatively thin filling layers and still obtain a high degree of heat insulation.

BRIEF DESCRIPTION OF THE DRAWING

The above and other objects, features and advantages of the present invention will now be described in more detail with reference to the accompanying drawing in which the sole FIGURE shows a schematic illustration of one embodiment of a ticking in accordance with the present invention for use in a fabric structure.

DETAILED DESCRIPTION OF A PREFERRED EMBODIMENT

Figure 1:
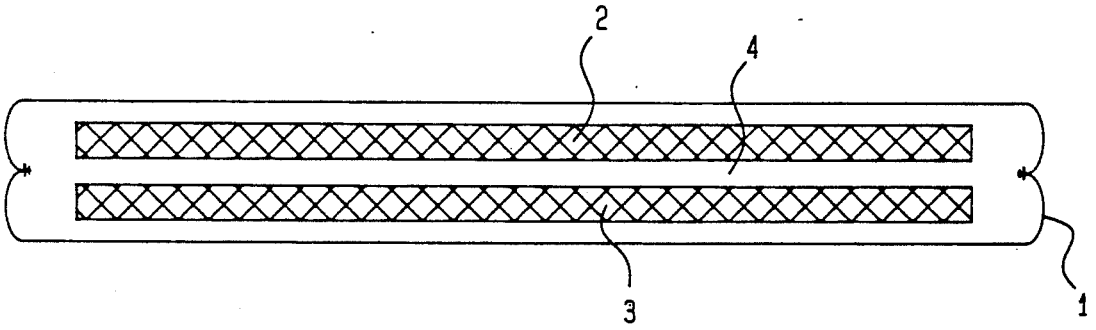

Referring now to the sole FIGURE, there is shown one embodiment of a ticking 1 for use in a fabric structure such as a covering. The ticking 1 is made with threads of e.g. natural fibers such as cotton, with the threads having a mass surface density in the range of 100–150 g/m$^2$, preferably 110–140 g/m$^2$, and a thread size of Nm 60–80, preferably 65–75. The threads, called warp and weft, are intersected in form of a plain weave (linen weave) or twill weave. In general, every weave has a certain number of "ups" and "downs" of the warp in relation to the weft which is represented by a symbolic notation. In accordance to the present invention, the repeating pattern of the plain weave is preferably L 1/1 (i.e. 1 lifted, 1 depressed).

Suitably, the warp threads and the weft threads are preferably made of a same thickness, with the warp threads having a density of 40–50 thread/cm and/or the weft threads having a density of 35–45 thread/cm.

As shown in the FIGURE, the ticking 1 includes two spaced filling layers 2, 3 with interposed air cushion 4. The filling layers 2, 3 are made of rabbit hair, in particular angora rabbit hair, and of foreign matter. The rabbit hair may be treated and/or may remain natural. The fraction of foreign matter is at least 30 weight-% and includes silk such as tussah silk, mohair, sheep wool, alpaca, camel hair, yang hair, polyester fibers, down or a mixture thereof. A typical mixing ratio is 20% pure angora rabbit hair, 40% pure sheep wool, and 40% pure tussah silk.

Persons skilled in the art will understand that the present invention should not be restricted to a fabric structure of two layers as illustrated in the FIGURE. It is certainly feasible, to provide a fabric structure e.g. with only one layer comprised of a ticking according to the invention which is filled with a natural fiber mixture as described above.

While the invention has been illustrated and described as embodied in a woven ticking, and a fabric structure made thereof, it is not intended to be limited to the details shown since various modifications and structural changes may be made without departing in any way from the spirit of the present invention.

What is claimed as new and desired to be protected by Letters Patent is set forth in the appended claims:

I claim:

1. A ticking in form of a textile weave of threads, with the threads having a mass surface density in the range of 100–150 g/m$^2$ at a thread size in the range of Nm 60–80.

2. The ticking defined in claim 1 wherein the threads are made of natural fibers.

3. The ticking defined in claim 2 wherein the threads are made of pure cotton.

4. The ticking defined in claim 1 wherein the threads have a mass surface density in the range of 110–140 g/m$^2$.

5. The ticking defined in claim 1 wherein the threads have a thread size of Nm 65–75.

6. The ticking defined in claim 1 wherein the textile weave is a plain weave.

7. The ticking defined in claim 6 wherein the plain weave has a L 1/1 pattern.

8. The ticking defined in claim 1 wherein the textile weave is a twill weave.

9. The ticking defined in claim 1, including warp threads and weft threads of same thickness.

10. The ticking defined in claim 1, including warp threads and weft threads, with the warp threads having a density of 40–50 thread/cm.

11. The ticking defined in claim 1, including warp threads and weft threads, with the weft threads having a density of 35–45 thread/cm.

12. The ticking defined in claim 1, including warp threads and weft threads, with the warp threads having a density of 40–50 thread/cm and the weft threads having a density of 35–45 thread/cm.

13. The ticking defined in claim 1 having an air permeability of 8–12 liter·dm$^{-2}$·min$^{-1}$.

14. The ticking defined in claim 1 having a fabric density according to WALZ of greater than 85%.

15. The ticking defined in claim 1, including warp threads and/or weft threads having a yarn twist of 850 to 950 T/m.

16. The ticking defined in claim 1 wherein the warp threads and/or weft threads are treated through desizing, washing, stretching and repeated calendering.

17. A covering of the type having a ticking and its filling, with the filling comprised of rabbit hair and at least 30 weight-% of foreign matter.

18. The covering defined in claim 17 wherein the foreign matter is selected from the group consisting of silk, mohair, down, sheep wool, alpaca, camel hair, polyester fibers, yang hair and a mixture thereof.

19. The covering defined in claim 17 wherein the filling includes angora rabbit hair.

20. The covering defined in claim 17 wherein the filling includes two spaced layers of filling material with interposed air cushion.

21. A fabric structure, comprising a ticking in form of a textile weave of threads, with the threads having a mass surface density in the range of 100–150 g/m$^2$ at a thread size in the range of Nm 60–80; and a filling composed of rabbit hair and at least 30% foreign matter.

* * * * *